US009158241B2

(12) United States Patent
Shimizu

(10) Patent No.: US 9,158,241 B2
(45) Date of Patent: Oct. 13, 2015

(54) IMAGE FORMING APPARATUS

(71) Applicant: CANON KABUSHIKI KAISHA, Tokyo (JP)

(72) Inventor: Yusuke Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/303,846

(22) Filed: Jun. 13, 2014

(65) Prior Publication Data

US 2014/0369706 A1 Dec. 18, 2014

(30) Foreign Application Priority Data

Jun. 17, 2013 (JP) ..... 2013-127001

(51) Int. Cl.
*G03G 15/20* (2006.01)
*G03G 15/16* (2006.01)
*G03G 15/01* (2006.01)

(52) U.S. Cl.
CPC ..... *G03G 15/1675* (2013.01); *G03G 15/0136* (2013.01); *G03G 15/1605* (2013.01); *G03G 2215/0129* (2013.01)

(58) Field of Classification Search
CPC ..... G03G 15/0136; G03G 15/1665; G03G 15/1675
USPC ..... 399/66, 314
See application file for complete search history.

(56) References Cited

FOREIGN PATENT DOCUMENTS

JP 2008-309904 A 12/2008

*Primary Examiner* — Erika J Villaluna
(74) *Attorney, Agent, or Firm* — Fitzpatrick, Cella, Harper & Scinto

(57) ABSTRACT

An image forming apparatus includes: a first image bearing member (drum); a second drum; a transfer belt; a first transfer member provided correspondingly to the first drum via the transfer belt; a second transfer member provided correspondingly to the second drum via the transfer belt; a high-voltage power source; and a controller. After an image is continuously formed on transfer materials by applying, to the first transfer member, a voltage of a predetermined polarity from the power source in a state that the first transfer member contacts the transfer belt and the second transfer member is spaced from the transfer belt, the controller executes an adjusting operation in which a voltage of a polarity opposite to the predetermined polarity is applied from the power source to the first transfer member in a state that the second transfer member is spaced from the transfer belt.

16 Claims, 9 Drawing Sheets

(a)

(b)

(a)

(b)

IMAGE FORMING APPARATUS

FIELD OF THE INVENTION AND RELATED ART

The present invention relates to an image forming apparatus of an electrophotographic type in which a multi-color image is formed on a recording material (medium) such as a transfer(-receiving) material.

As the image forming apparatus, of the electrophotographic type, for forming the multi-color image, apparatuses of various types have been proposed.

As one of such image forming apparatuses, an apparatus of an in-line type in which image forming stations for yellow (Y), magenta (M), cyan (C) and black (K) are provided in line at a periphery of an intermediary transfer belt as an intermediary transfer member has been conventionally known. At each of the image forming stations, a photosensitive drum which is a drum-shaped electrophotographic photosensitive member as an image bearing member is provided. At a periphery of each photosensitive drum, a charging roller for electrically charging the photosensitive drum surface, an exposure device for exposing the charged photosensitive drum surface to light depending on image information or the like to form an electrostatic latent image, and a developing means for developing the electrostatic latent image into a toner image are provided. Depending on the image information from a host computer, an image reading device or the like, the toner image is formed on the photosensitive drum and then is transferred from the photosensitive drum onto the intermediary transfer belt. The transfer of the toner image onto the intermediary transfer belt is carried out by applying a transfer voltage to a transfer member located at an opposite position of the photosensitive drum via the intermediary transfer belt. In the conventional image forming apparatus, to each of the transfer members, a high-voltage power source for the transfer voltage is connected.

However, in recent years, as a result of advance of downsizing and cost reduction of the apparatus, an apparatus in which commonality of the high-voltage power source, for the transfer voltage, to be applied for transferring the toner (image) from the photosensitive drum onto the intermediary transfer belt is provided among a plurality of image forming stations is disclosed.

For example, Japanese Laid-Open Patent Application (JP-A) 2008-309904 discloses an image forming apparatus having achieved commonality of a high-voltage power source among three image forming stations. Such an image forming apparatus is operable in a multi-color mode in which image formation is effected simultaneously at all the image forming stations for yellow (Y), magenta (M), cyan (C) and black (K). In the multi-color mode, a voltage of the same value is applied from a common power source to primary transfer members of all the image forming stations, and therefore a current flows through all the image forming stations.

On the other hand, e.g., in the case where the image formation is carried out only at the black image forming station (in the case where an operation in a monochromatic mode is executed), the current flows through only the black image forming station. For example, in the case of a constitution in which the primary transfer members of the yellow, magenta and cyan image forming stations as non-image forming stations are spaced from the intermediary transfer belt, current paths of the yellow, magenta and cyan image forming stations are blocked. For this reason, the current flows through only the black image forming station.

In this way, in the image forming apparatus capable of executing the operations in the multi-color mode and the monochromatic mode, there is the case where the operation in the monochromatic mode is executed for a longer time than the operation in the multi-color mode, and in such a case, image defect can occur due to an imbalance in mode.

SUMMARY OF THE INVENTION

A principal object of the present invention is to provide an image forming apparatus capable of suppressing image defect generated due to continuous image formation in an operation in a monochromatic mode.

These and other objects, features and advantages of the present invention will become more apparent upon a consideration of the following description of the preferred embodiments of the present invention taken in conjunction with the accompanying drawings.

DESCRIPTION OF THE EMBODIMENTS

With reference to the drawings, embodiments of the image forming apparatus according to the present invention will be described specifically below.

<Embodiment 1>

(General Structure of Image Forming Apparatus)

Figure 1:
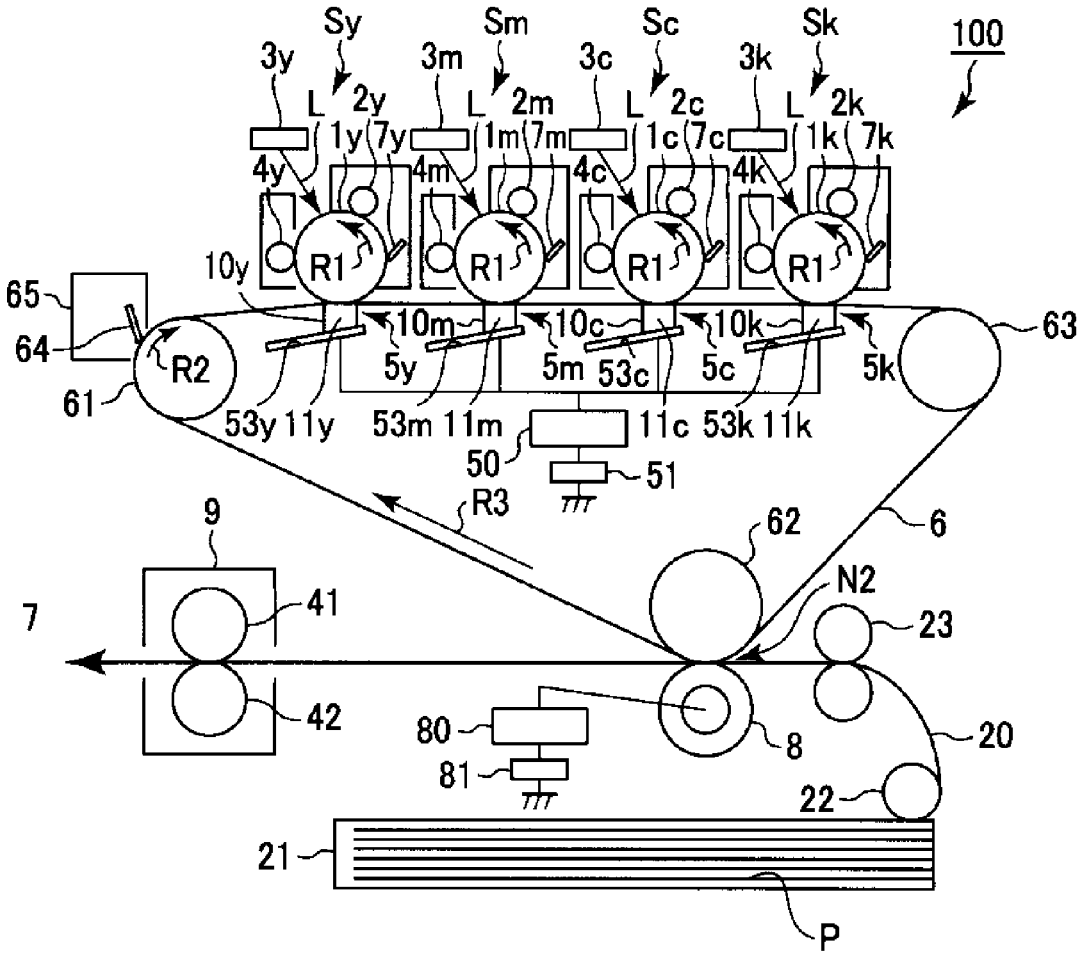
FIG. 1 is a schematic sectional view for illustrating an image forming apparatus in Embodiment 1 according to the present invention.

FIG. 1 is a schematic sectional view showing a general structure of an image forming apparatus 100 according to this embodiment of the present invention. The image forming apparatus 100 in this embodiment is a full-color laser beam printer of an electrophotographic type.

In the image forming apparatus 100, toner images of a plurality of colors each formed on the associated image bearing member in accordance with image information separated into a plurality of color components are successively primary-transferred superposedly onto an intermediary transfer belt and thereafter are collectively secondary-transferred onto a transfer material P (recording material) to obtain a recording image.

The image forming apparatus 100 includes, as a plurality of image forming portions, first to fourth image forming stations Sy, Sm, Sc and Sk. The first to fourth image forming stations Sy, Sm, Sc and Sk are disposed in a roughly linear shape along an intermediary transfer belt 6 as an intermediary transfer member in a belt shape.

The first to fourth image forming stations Sy, Sm, Sc and Sk are used for forming toner images of yellow (Y), magenta (M), cyan (C) and black (K), respectively. A constitution in which when there is no remaining toner amount, a voltage constituting each image forming station is replaceable with a new unit is employed.

Constitutions and operations are common to the first to fourth image forming stations Sy, Sm, Sc and Sk in many cases, and therefore, in the case where there is no need to particularly distinguish the image forming stations, description will be made by omitting suffixes, y, m, c and k for representing elements provided for associated colors.

The image forming apparatus 100 includes a photosensitive drum 1 which is a drum-shaped electrophotographic photosensitive member as an image bearing member in the image forming station S. Further, at a periphery of the photosensitive drum 1, a charging roller 2 as a charging means, an exposure device 3 as an electrostatic latent image forming means, a developing device 4 as a developing means, and a cleaning device 7 as a cleaning means are provided.

Further, a primary transfer brush 5 as a primary transfer member for transferring the toner image formed on each photosensitive drum 1 onto the intermediary transfer belt 6 is provided at an opposing position to the photosensitive drum 1 via the intermediary transfer belt 6. Further, the image forming apparatus 100 includes a secondary transfer means 8 for transferring the toner image from the intermediary transfer belt 6 onto the transfer material P, a fixing device 9 for fixing the toner image transferred on the transfer material P, and a feeding unit 23 or the like for feeding the transfer material P. Further, at a lower portion of the image forming apparatus 100, a transfer material cassette 21 for accommodating the transfer material is provided.

The photosensitive drum 1 is rotationally driven in an arrow R1 direction (counterclockwise direction), indicated in FIG. 1, by a driving means (not shown). A surface of the photosensitive drum 1 is electrically charged uniformly by the charging roller 2.

Then, based on image information from an unshown host computer or an unshown image reader, the surface of the photosensitive drum 1 is irradiated with laser light L, in accordance with the image information, emitted from the exposure device 3, so that the electrostatic latent image is formed on the photosensitive drum 1. When the surface of the photosensitive drum 1 further moves in the arrow R1 direction, the electrostatic latent image formed on the surface of the photosensitive drum 1 is developed and visualized as a toner image by the developing device 4.

The developing device 4 effects development by depositing, on an image portion (exposed portion) on the uniformly charged photosensitive drum 1, a toner charged to the same polarity (negative) as a charge polarity (negative) of the photosensitive drum 1.

With respect to a rotational movement direction of the surface of the photosensitive drum 1 shown by the arrow R1 in FIG. 1, an intermediary transfer belt 6 is disposed downstream of a developing position.

(Intermediary Transfer Belt)

Next, the intermediary transfer belt will be described.

The intermediary transfer belt 6 is a cylindrical and endless belt-like film stretched by three rollers consisting of a driving roller 61, a secondary transfer opposite roller 62 and a tension roller 63.

As a base resin material for the intermediary transfer belt 6, it is possible to use thermoplastic resin materials such as polycarbonate, polyvinylidene fluoride (PVDF), polyethylene, polypropylene, polymethylpentene-1, polystyrene, polyamide, polysulfone, polyalylate, polyethylene terephthalate, polybutylene terephthalate, polyethylene naphthalate, polybutylene naphthalate, polyphenylene sulfide, polyether sulfide, polyether nitrile, thermoplastic polyamide, polyether ether ketone, thermotropic liquid crystal polymer, and polyamide acid. These materials can also be in mixture of two or more species. The intermediary transfer belt 6 contains an electroconductive agent for imparting electroconductivity thereto. In the image forming apparatus in this embodiment, by employing an ion conductive intermediary transfer belt 6, compared with the case where an electron conductive agent is used, it is possible to suppress manufacturing tolerance in resistance at a low level.

As the ion conductive agent, it is possible to use polyvalent metal salts, quaternary ammonium salts, and the like. The quaternary ammonium salt may contain a cationic component, such as tetraethylammonium ion, tetrapropylammonium ion, tetraisopropylammonium ion, tetrabutylammonium ion, tetrapentylammonium ion, or tetrahexylammonium ion, and an anionic component, such as halogen ion, fluoroalkyl sulfate ion having 1-10 carbon atoms, fluoroalkyl sulfite ion or fluoroalkyl borate ion.

The above-described ingredients are melt-kneaded and are then subjected to molding appropriately selected from inflation molding, cylindrical extrusion molding and injection stretch blow molding, thus obtaining the intermediary transfer belt 6 as a resin composition. Further, as a surface layer of the intermediary transfer belt 6, an acrylic coat layer having a high hermetically sealing property is provided.

The intermediary transfer belt 6 is moved in an arrow R3 direction (clockwise direction) shown in FIG. 1 at the substantially same speed as a surface monochromatic speed of the photosensitive drum 1 by rotational drive of the driving roller 61 in an arrow R2 direction (clockwise direction) shown in FIG. 1. At a position opposing the photosensitive drum 1 via the intermediary transfer belt 6, a primary transfer brush 5 (transfer means) is provided. The primary transfer brush 5 is not configured to be rotated by rotation (movement) of the intermediary transfer belt 6 as in the case of a transfer roller, but is a fixed transfer member to be rubbed against the intermediary transfer belt 6 with no rotation at a contact portion. By the action of a transfer voltage applied from a primary transfer power source (transfer high-voltage power source) 50 to the primary transfer brush 5, the toner image formed on the photosensitive drum 1 is transferred onto an outer peripheral surface of the intermediary transfer belt 6 with rotation of the photosensitive drum 1 and the intermediary transfer belt 6. A primary transfer current supplied by the primary transfer power source 50 is detected by a primary transfer current detected circuit (not shown).

The primary transfer brush 5 in this embodiment is contactable to and separable from the intermediary transfer belt 6 relative to the photosensitive drum 1 by a contact-and-separation unit 70 specifically described later with reference to (a) and (b) of FIG. 3. That is, as shown in (a) of FIG. 3, in a contact state, brush fibers 11 held on a swingable arm 53 constituting the transfer brush 5 push up a back surface of the intermediary transfer belt 6, so that the outer peripheral surface of the intermediary transfer belt 6 is contacted to the surface of the photosensitive drum 1 at a contact pressure of 400 gf. As shown in (b) of FIG. 3, in a spaced (separated) state, the transfer brush 5 is spaced from the intermediary transfer belt 6, and at the same time, the intermediary transfer belt 6 is spaced from the photosensitive drum 1, with the result that a current (flow) path is interrupted.

A transfer residual toner remaining on the photosensitive drum 1 without being transferred onto the intermediary transfer belt 6 in a primary transfer step is removed by the photosensitive drum cleaning blade 7 and then is accommodated in a residual toner box (container).

The above-described steps of charging, exposure, development and transfer are carried out for the respective colors at the first to fourth image forming stations Sy to Sk in the order starting from an upstream side of a movement direction of the outer peripheral surface of the intermediary transfer belt. As a result, a full-color image obtained by the four color toner images superposed on the intermediary transfer belt 6 is formed on the intermediary transfer belt 6. A secondary transfer roller 8 is urged toward the secondary transfer opposite roller 62 via the intermediary transfer belt 6. The transfer material P accommodated in the cassette 21 is after being fed by a feeding roller 22, supplied by a registration roller pair 23 at predetermined timing into a nip N2 formed between the intermediary transfer belt 6 and the secondary transfer roller 8. The toner images on the intermediary transfer belt 6 are collectively transferred onto the transfer material P by the action of a voltage applied from a secondary transfer power source 80 to the secondary transfer roller 8.

At a position opposing the driving roller 61 via the intermediary transfer belt 6, a cleaning blade 64 is provided, and the toner remaining on the intermediary transfer belt 6 without being transferred onto the transfer material P in a secondary transfer step is accommodated in a transfer residual toner box (container) 65. The secondary-transferred toner images on the transfer material P are fixed by heat and pressure at a fixing nip formed by a fixing roller 41 and a pressing roller 42. Thereafter, the transfer material P is conveyed to an outside 7 of the image forming apparatus 100 by an unshown conveying roller.

(Primary Transfer Current)

In this embodiment, for the purpose of cost reduction and downsizing of the image forming apparatus 100, commonality of the primary transfer power source 50 for supplying electric power to the primary transfer brushes 5*y*, 5*m*, 5*c* and 5*k* is achieved among the four image forming stations. Accordingly, to each of the primary transfer brushes 5*y*, 5*m*, 5*c* and 5*k* of the image forming stations, a primary transfer voltage of the same value is applied. As a result, in a state in which all the image forming stations contact the intermediary transfer belt 6 during full-color (multi-color) image formation as shown in (a) of FIG. 2, a current of the substantially same value flows through each of the image forming stations. On the other hand, in a state in which the primary transfer brushes 5*y*, 5*m* and 5*c* are spaced from the intermediary transfer belt 6 during monochromatic image formation, i.e., during single color image formation for black (K) in this embodiment as shown in (b) of FIG. 2, current paths along which the current flows through the image forming stations Sy, Sm and Sc are interrupted. For this reason, the current does not flow through the image forming stations Sy, Sm and Sc, but flows through only the black image forming station Sk kept in the contact state.

With reference to (a) and (b) of FIG. 20, the primary transfer brush 5 and the contact-and-separation unit 70 will be described.

(Primary Transfer Brush)

At a primary transfer portion of the image forming apparatus 100 in this embodiment, the primary transfer brush 5 is disposed at an opposing portion to the photosensitive drum 1 via the intermediary transfer belt 6. The primary transfer brush 5 as a brush-like transfer member of the image forming apparatus 100 in this embodiment includes the brush fibers 11 held by a base (holding portion) 53. The base 53 is provided with the brush fibers 11 at an end surface 53*a* in a side where the brush fibers 11 are contactable to the intermediary transfer belt 6. At the other end surface 53*b*, the base 53 is swingably fixed to a frame 55 as a device base by a shaft 54. In a back surface side, opposite from the brush fibers 11, of the base 53 which is a swingable arm, an urging spring 9 contacts the swingable arm 53 at an end portion 9*a* and urges the brush fibers 11 toward the intermediary transfer belt 6. At the other end portion 9*b* of the urging spring 9 in a side where the urging spring 9 does not contact the swingable arm 53, the urging spring 9 is supported by the frame 55. Further, at a portion over and in the neighborhood of the shaft 54 of the swingable arm 53, an eccentric cam 21 is provided in the intermediary transfer belt 6 side.

Figure 3:
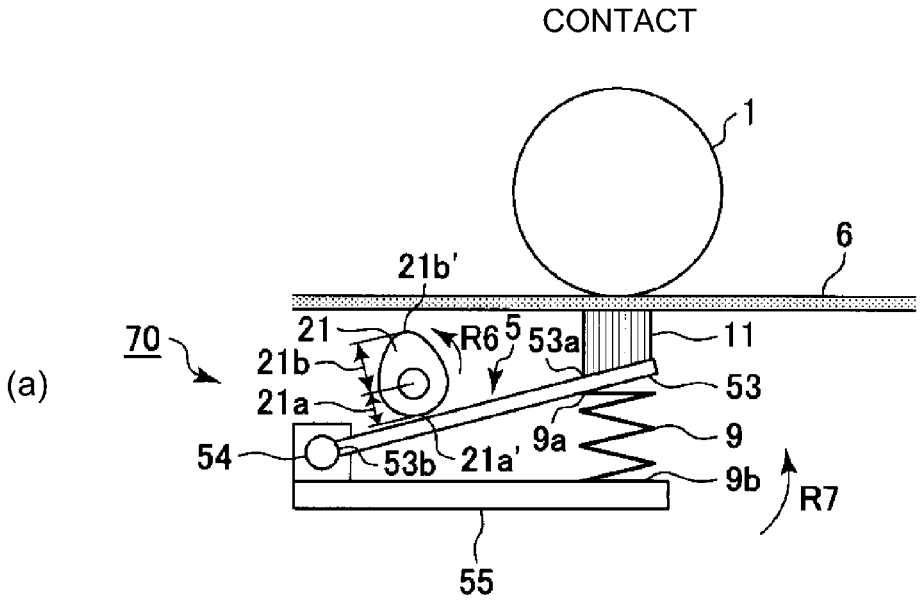
In FIG. 3, (a) and (b) are schematic sectional views for illustrating a contact-and-separation unit for moving the primary transfer member toward and away from a photosensitive drum via an intermediary transfer belt in the image forming apparatus in Embodiment 1, in which (a) shows a contact state, and (b) shows a spaced state.
Figure 3:
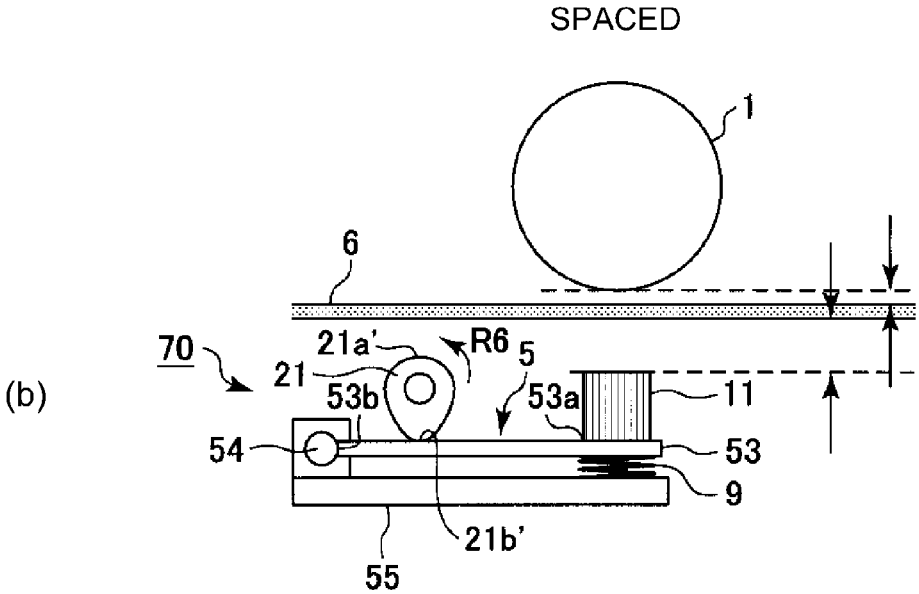

The primary transfer brush 5 pushes up the intermediary transfer belt 6 by an urging force of the urging spring 9, so that the outer peripheral surface of the intermediary transfer belt 6 contacts the photosensitive drum 1 at a contact pressure of 400 gf ((a) of FIG. 3).

Figure 2:
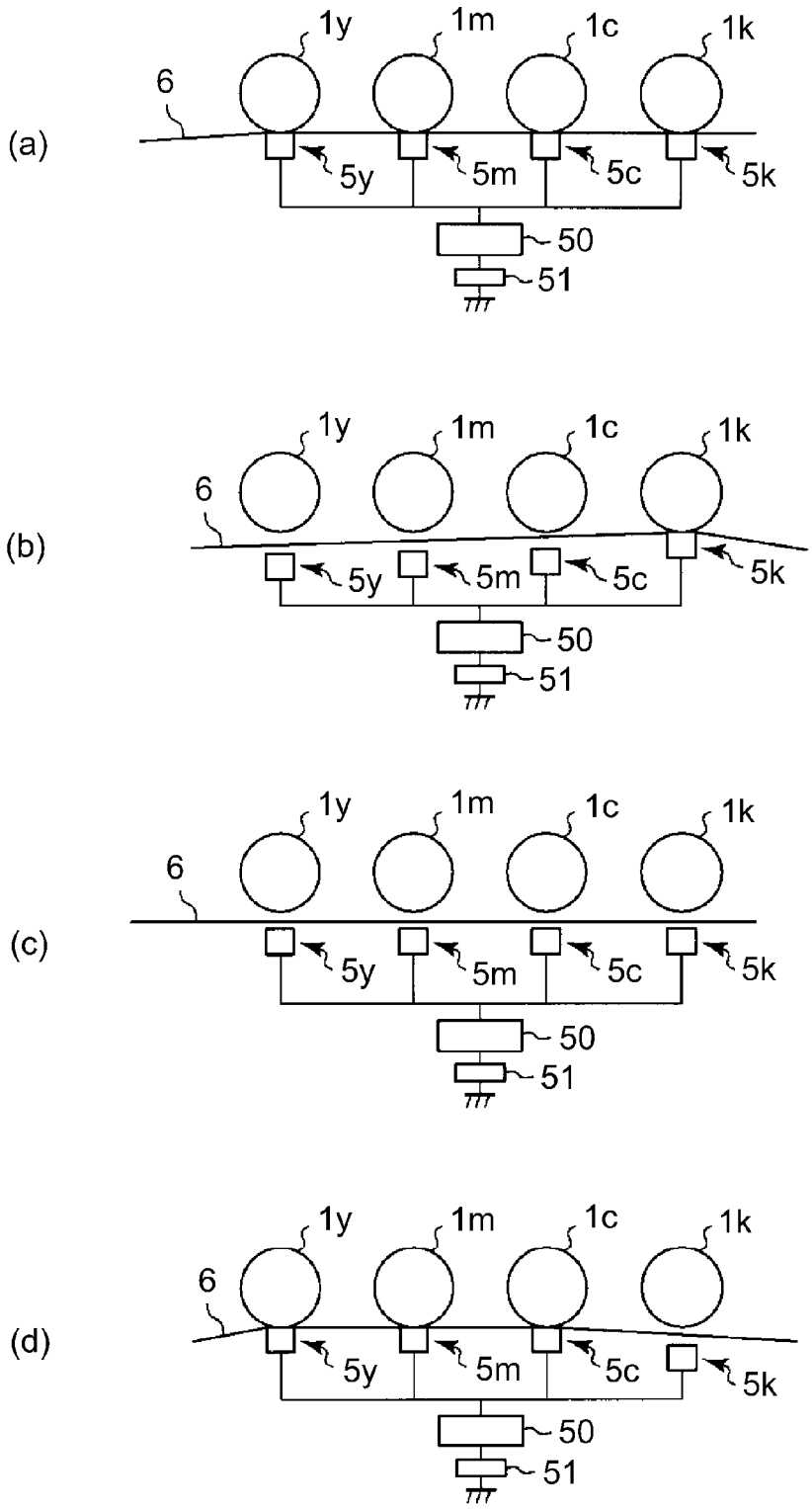
In FIG. 2, (a) to (d) are schematic sectional views for illustrating a contact-and-separation state of primary transfer members of the image forming apparatus in Embodiment 1, in which (a) shows a contact state of the primary transfer members of all of image forming stations, (b) shows a contact state of the primary transfer member of only a black image forming station, (c) shows a spaced state of the primary transfer members of all the image forming stations, and (d) shows a contact state of the primary transfer members of the image forming stations except the black image forming station.

Further, as shown in (a) to (d) of FIG. 2, to each of the primary transfer brushes 5, the primary transfer power source 50 is connected. The primary transfer power source 50 supplies electric power to the brush fibers 11 via the spring 9. The brush fibers 11 are constituted by electroconductive fibers, and as the electroconductive fibers, fibers formed of a material, such as nylon or polyester, in which carbon black powder is dispersed are used. In this embodiment, electroconductive fibers of the type in which the carbon black powder is dispersed in nylon are used. The brush fibers 11 may desirably have single yarn fineness in a range of 2-15 dtex. In this embodiment, the brush fibers 11 having the single yarn fineness of 7 dtex are used. A resistivity ρfiber of the brush fibers 11 may suitably be in a range of $10\text{-}10^8$ Ω.cm for the purpose of increasing transfer efficiency. In this embodiment, the brush fibers 11 having the resistivity of $10^6$ Ω.cm are used.

(Contact-and-separation Unit)

In FIG. 3, (a) and (b) are schematic enlarged views showing the contact-and-separation unit 70 for each of the primary transfer brushes 5*y*, 5*m*, 5*c* and 5*k*. The same constitution is employed in the respective image forming stations Sy, Sm, Sc and Sk, and therefore, in the following, suffixes y, m, c and k will be omitted. The eccentric cam 21 is, when an unshown clutch is connect thereto, rotated in an arrow R6 direction in the figures by a driving force transmitted from an unshown gear mounted coaxially with the secondary transfer opposite roller 62. The eccentric cam 21 in this embodiment has a short diameter 21*a* and a long diameter 21*b* as shown in (a) of FIG. 3. The eccentric cam 21 has a structure such that an outer diameter portion thereof does not contact the swingable arm 53 when the neighborhood of an outer diameter point 21*a*' of the short diameter 21*a* is directed toward the swingable arm 53 side. Further, as shown in (b) of FIG. 3, an outer diameter point 21*b*' of the long diameter 21*b* is directed toward the swingable arm 53 side, the outer diameter point 21*b*' of the eccentric cam 21 contacts the swingable arm 53, and at the same time, the swingable arm 53 is urged, so that the swingable arm 53 is substantially in parallel to the intermediary transfer belt 6.

When the eccentric cam 21 is rotated in the arrow R6 direction from the state in which the point 21*b*' thereof in the long diameter 21*b* side is directed toward the swingable arm 53 side, the urging of the eccentric cam 21 against the swingable arm 53 is released (eliminated), so that the swingable arm 53 is rotated in an arrow R7 direction shown in (a) of FIG. 3 about the swing shaft 54 by the urging force of the urging spring 9. At this time, the eccentric cam 21 is rotated so that the short diameter 21*a* side of a diameter from a rotation shaft thereof is directed toward the base 53 as the swingable arm. When the swingable arm 53 is rotated, the primary transfer brush 5 pushes up the intermediary transfer belt 6 by the urging force of the urging spring 9, so that the outer peripheral surface of the intermediary transfer belt 6 contacts the photosensitive drum 1 at the contact pressure of 400 gf. This state is hereinafter referred to as a contact state. In FIG. 3, (a) shows the contact state in which the primary transfer brush 5 urges the intermediary transfer belt 6 to bring the intermediary transfer belt 6 into contact with the photosensitive drum 1.

When the eccentric cam 21 is further rotated from the contact state in the arrow R6 direction by the driving force transmitted from the unshown gear, a state in which the point 21*b*' of the eccentric cam 21 in the long diameter 21*b* side is directed toward the swingable arm 53 side is created. At this time, as shown in (b) of FIG. 3, the outer diameter point 21*b*' of the outer diameter 21*b* of the eccentric cam 21 contacts the swingable arm 53, whereby the swingable arm 53 is pushed down. Then, the primary transfer brush 5 is spaced from the intermediary transfer belt 6, and at the same time, the intermediary transfer belt 6 is spaced from the photosensitive drum 1. This state is hereinafter referred to as a spaced (separated) state. In FIG. 3, (b) shows this spaced state. In the image forming apparatus 100 in this embodiment, at the time of start and end of the image formation, a full spaced state in which the primary transfer brushes 5 are spaced from the intermediary transfer belt 6 at all the image forming stations, Sy, Sm, Sc and Sk is created.

(Image Forming Sequence)

Figure 4:
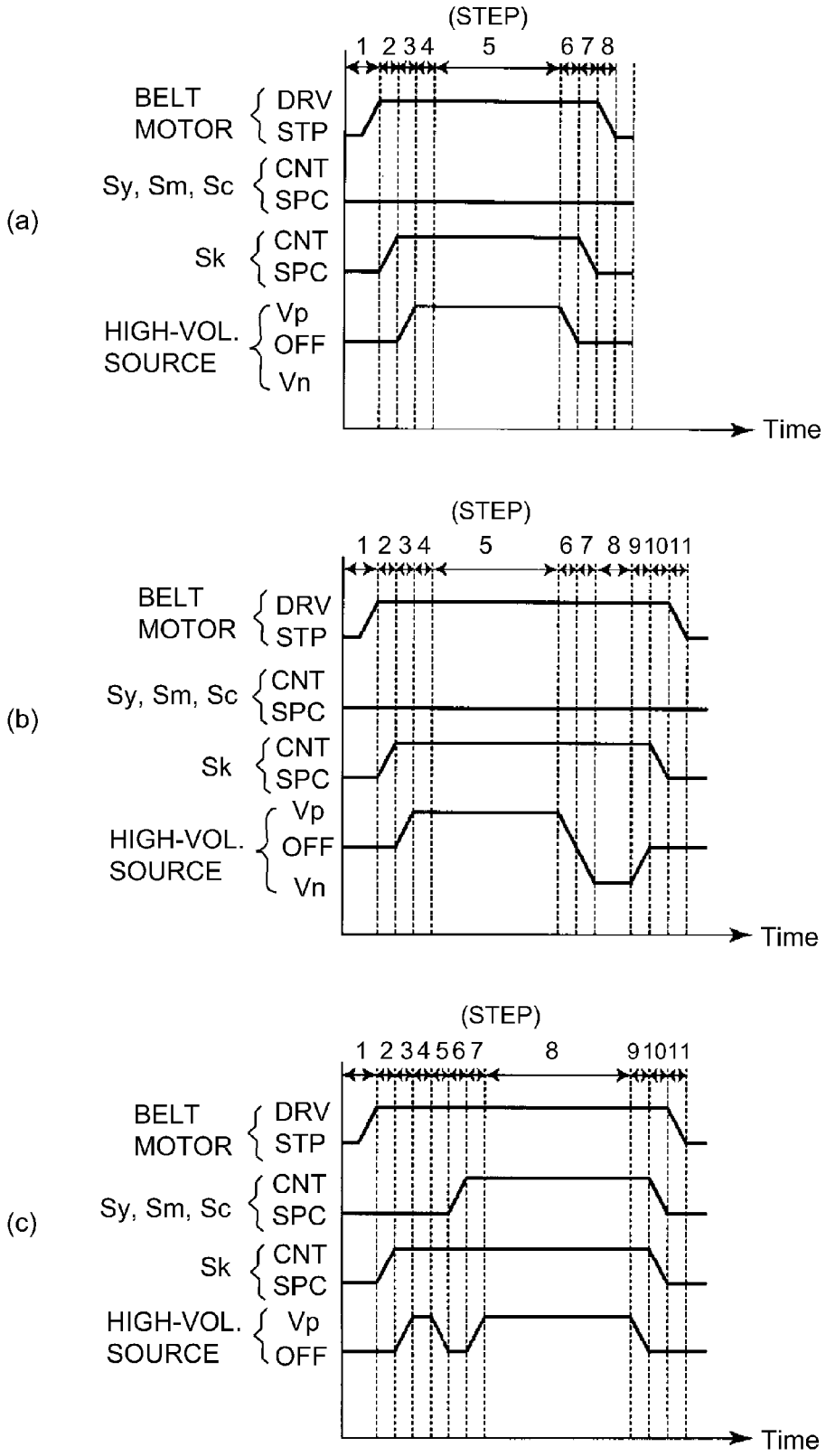
In FIG. 4, (a) to (c) are time charts for illustrating image forming sequences of the image forming apparatus in Embodiment 1, in which (a) shows a first monochromatic image forming sequence, (b) shows a second monochromatic image forming sequence, and (c) shows a full-color image forming sequence.

The image forming apparatus 100 in this embodiment is capable of executing a first monochromatic image forming sequence and a second image forming sequence shown in (a) and (b) of FIG. 4, respectively. The first monochromatic image forming sequence is a monochromatic image forming sequence in which monochromatic image formation is effected similarly as in a conventional monochromatic image forming sequence. The second monochromatic image forming sequence is a monochromatic image forming sequence executed depending on a print number of monochromatic image formation continuously effected for a predetermined time, and is an image forming sequence peculiar to the image forming apparatus 100 in this embodiment. In this embodiment, in accordance with a flowchart shown in FIG. 5, whether or not which of the first and second monochromatic image forming sequences should be executed is determined. In FIG. 4, (c) shows a sequence during full-color image formation. The sequence during the full-color image formation (full-color image forming sequence) will be described later. Here, the black photosensitive drum 1 in the monochromatic image formation is referred to as a first image bearing member, and the black primary transfer brush 5*k* is referred to as a first transfer member. Further, the yellow, magenta and cyan photosensitive drums 1*y*, 1*m* and 1*c* in the full-color image formation are referred to as a second image bearing member, and the corresponding primary transfer brushes 5*y*, 5*m* and 5*c* are referred to as a second transfer member.

First, the first and second monochromatic image forming sequences will be described below.

(First Monochromatic Image Forming Sequence)

In this embodiment, (a) of FIG. 4 shows a sequence chart the first monochromatic image forming sequence. The first monochromatic image forming sequence will be described with reference to FIG. 1, (b) and (c) of FIG. 2, and (a) of FIG. 4. The first monochromatic image forming sequence shown in (a) of FIG. 4 is a sequence for performing a monochromatic image forming operation similarly as in the conventional monochromatic image forming sequence. In this embodiment, the monochromatic image forming operation for black (K) is performed.

When CPU 51 as a controller shown in FIG. 1 receives a print signal from an unshown host information device such as a personal computer, the CPU 51 starts a printing operation to activate (actuate) an unshown intermediary transfer belt driving motor (step 1). The CPU 51 rotates the eccentric cam 21*k* of the black image forming station Sk by connecting an unshown clutch with the eccentric cam 21*k*. Then, as shown in (b) of FIG. 2, only the primary transfer brush 5*k* as the first transfer member is placed in the contact state with the intermediary transfer belt 6 toward the photosensitive drum 1*k* as the first image bearing member (step 2). After the primary transfer brush 5*k* is placed in the contact state, the primary transfer power source 50 as a high-voltage power source is activated (step 3). The CPU 51 effects a constant current control of the primary transfer power source 50 at a target current Im, and then stores a generated voltage value Va of the primary transfer power source 50 at that time for a predetermined time to calculate an average Vp (step 4). After the calculation of the average Vp, Vp is applied as a transfer voltage for the image formation, that the toner image is transferred from the photosensitive drum 1*k* onto the outer peripheral surface of the intermediary transfer belt 6 (step 5). After the toner image is completely transferred from the photosensitive drum 1*k* onto the outer peripheral surface of the intermediary transfer belt 6, the application of the transfer voltage Vp is ended and then the primary transfer power source 50 is deactivated (step 6). After the deactivation of the primary transfer power source 50 is ended, the CPU 51 connects the unshown clutch to the eccentric cam 21*k* to rotate the eccentric cam 21*k*, so that as shown in (c) of FIG. 2, the primary transfer brush 5*k* is placed in the spaced state from the intermediary transfer belt 6 (step 7). After the spacing operation is ended, the unshown intermediary transfer belt driving motor is deactivated (step 8).

(Second Monochromatic Image Forming Sequence)

In this embodiment, (b) of FIG. 4 shows a sequence chart the second monochromatic image forming sequence. The second monochromatic image forming sequence will be described with reference to FIG. 1, (b) and (c) of FIG. 2, and (b) of FIG. 4.

When the CPU 51 receives a print signal from an unshown host information device such as a personal computer, the CPU 51 starts a printing operation to activate (actuate) an unshown intermediary transfer belt driving motor (step 1). The CPU 51 rotates the eccentric cam 21*k* of the black image forming station Sk by connecting an unshown clutch with the eccentric cam 21*k*. Then, as shown in (b) of FIG. 2, only the primary transfer brush 5*k* is placed in the contact state with the intermediary transfer belt 6 toward the photosensitive drum 1*k* (step 2). After the primary transfer brush 5*k* is placed in the contact state, the primary transfer power source 50 is activated (step 3). The CPU 51 effects a constant current control of the primary transfer power source 50 at a target current Im, and then stores a generated voltage value Va of the primary transfer power source 50 at that time for a predetermined time to calculate an average Vp (step 4). After the calculation of the average Vp, Vp is applied as a transfer voltage for the image formation, that the toner image is transferred from the photosensitive drum 1*k* onto the outer peripheral surface of the intermediary transfer belt 6 (step 5). After the toner image is completely transferred from the photosensitive drum 1*k* onto the outer peripheral surface of the intermediary transfer belt 6, the application of the transfer voltage Vp is ended and then the primary transfer power source 50 is deactivated (step 6). After the deactivation of the primary transfer power source 50 is ended, application of an adjusting voltage Vn of a polarity opposite to the polarity of the transfer voltage Vp is started at this time as non-image formation time (step 7). The adjusting voltage Vn of the opposite polarity is applied for a predetermined time T1 (step 8). After the adjusting voltage Vn of the opposite polarity is applied for the predetermined time T1, the primary transfer power source 50 is turned off (step 9). After the adjusting voltage Vn of the opposite polarity is turned off, the CPU 51 connects the unshown clutch to the eccentric cam 21*k* to rotate the eccentric cam 21*k*, so that as shown in (c) of FIG. 2, the primary transfer brush 5*k* is placed in the spaced state (step 10). After the spacing operation is ended, the unshown intermediary transfer belt driving motor is deactivated (step 11).

The first monochromatic image forming sequence ((a) of FIG. 4) and the second image forming sequence ((b) of FIG. 4) are different in that the adjusting voltage Vn of the opposite polarity to the polarity of the transfer voltage Vp is applied in the second image forming sequence.

In the case where an ion conductive belt is used as the intermediary transfer belt 6 in such an image forming apparatus, the current flows through the belt, so that an electric field is generated in a belt layer. By the electric field generated in the belt layer, anion (negative ion) and cation (positive ion) which provide an in conductive property receive forces from the electric field, so that the positively charged cation is moved in a direction of the electric field, and the negatively charged anion is moved by receiving the force in a direction opposite to the direction of the electric field. That is, when, e.g., positive electric charges are applied to the primary transfer member, the cation is moved toward the outer peripheral surface side of the intermediary transfer belt 6, and the anion is moved toward the inner peripheral surface side of the intermediary transfer belt 6.

Accordingly, in the case where the image formation is continuously carried out, when, e.g., a positive voltage is applied as an image forming voltage to the primary transfer member, the cation continuously receives the force toward the outer peripheral surface side of the intermediary transfer belt 6. However, the intermediary transfer belt 6 has, as the surface layer, the coat layer of acrylic resin or the like having the high hermetically sealing property, and therefore, the cation is blocked by the coat layer, so that the cation is not deposited on the outer peripheral surface of the intermediary transfer belt 6.

On the other hand, the intermediary transfer belt 6 is not provided in general at the back surface with the coat layer, and therefore, the anion is moved toward the back surface side of the intermediary transfer belt 6 by the continuously applied force by the action of the electric field and is deposed on the back surface of the intermediary transfer belt 6, so that a compound is formed and loses electroconductivity thereof.

The compound which is deposited on the back surface of the intermediary transfer belt 6 and which loses the electroconductivity causes an increase in surface resistance of the primary transfer brush. As a result, in the case where the image formation in the operation in the monochromatic image forming mode is continuously carried out, the surface resistance of the primary transfer brush at the black image forming station is increased compared with those of the primary transfer brushes at other image forming stations. In this state, the image formation is carried out in the operation in the full-color image forming mode, at the black image forming station, a transfer electric field is smaller than those at the image forming stations correspondingly to a voltage influenced by a deposit deposited on the primary transfer brush.

Here, when an output value of the primary transfer power source 50 for applying the transfer voltage to the primary transfer brush is optimized for the image forming stations other than the black image forming station, i.e., for the yellow, magenta and cyan image forming stations, the electric field is insufficient at the black image forming station. By this insufficient electric field, a phenomenon such that the toner image on the photosensitive drum at the black image forming station cannot be transferred onto the intermediary transfer belt generates (weak-field transfer error (failure)).

On the other hand, when the output value of the primary transfer power source 50 for applying the transfer voltage to the primary transfer brush is optimized for the black image forming station, the transfer electric field becomes excessively strong at the yellow, magenta and cyan image forming stations. For this reason, a phenomenon such that triboelectric charges of the toners on the photosensitive drums at the yellow, magenta and cyan image forming stations are reversed by electric discharge and thus the toner images cannot be transferred onto the intermediary transfer belt generates (strong-field transfer error (failure)).

As described above, when the monochromatic image formation is repeated only in the first image forming sequence, in the ion conductive intermediary transfer member (intermediary transfer belt 6), the anion is moved toward the primary transfer member (primary transfer brush 5) side by the electric field and then is deposited. As a result, the resistance of the primary transfer brush 5*k* at the black image forming station Sk is increases, so that the image defect is generated due to a resistance difference even when a predetermined current is caused to flow through the primary transfer brush 5*k*. However, in the second monochromatic image forming sequence, by applying the adjusting voltage Vn of the opposite polarity to the polarity of the transfer voltage Vp, the anion moved to the primary transfer brush 5*k* side can be moved back from the primary transfer brush 5*k* side toward the photosensitive drum 1 side.

As described above, in the case where the monochromatic image formation is continuously effected for the predetermined time, i.e., when the image formation of a plurality of transfer materials is continuously carried out, under application of the transfer voltage Vp during the monochromatic image formation, the anion is moved toward the back surface side of the belt by the transfer electric field. However, the second monochromatic image forming sequence is executed to apply the adjusting voltage Vp of the opposite polarity to the polarity of the transfer voltage Vp, so that the anion is returned toward the front surface side of the belt. As a result, the deposition of the anion in the belt back surface side is suppressed and prevented, so that the increase in resistance at the black image forming station is suppressed and prevented. That is, after end of the single color image formation which is the monochromatic image formation, the adjusting voltage Vn of the opposite polarity to the polarity of the transfer voltage Vp is applied to the corresponding primary transfer brush 5*k*, whereby the deposition of the anion on the intermediary transfer belt 6 is suppressed, and thus it is possible to suppress and prevent the increase in resistance. Here, such an operation in which the adjusting voltage Vn of the opposite polarity to the polarity of the transfer voltage Vp is applied to the associated primary transfer brush 5*k* after the single color image formation is ended is referred to as an adjusting operation, and the adjusting operation is executed by carrying out the second monochromatic image forming sequence.

(Full-color Image Forming Sequence)

In this embodiment, (c) of FIG. 4 shows a sequence chart during the full-color image forming sequence. The full-color image forming sequence will be described with reference to FIG. 1, (a) and (c) of FIG. 2, and (c) of FIG. 4. The full-color image forming sequence is the same as the conventional full-color image forming sequence.

When the image forming apparatus 100 receives a print signal from an unshown host information device such as a personal computer, the image forming apparatus 100 starts a printing operation to carry out an activating operation (rising operation) of the unshown intermediary transfer belt driving motor (step 1). The CPU 51 rotates the eccentric cam 21*k* of the black image forming station Sk by connecting an unshown clutch with the eccentric cam 21*k*. Then, as shown in (b) of FIG. 2, only the primary transfer brush 5*k* as the first transfer member is placed in the contact state with the intermediary transfer belt 6 toward the photosensitive drum 1*k* as the first image bearing member (step 2). After the primary transfer brush 5*k* is placed in the contact state, the primary transfer power source 50 is activated (step 3). The CPU 51 effects a constant current control of the primary transfer power source 50 at a target current Im, and then stores a generated voltage value Va of the primary transfer power source 50 at that time for a predetermined time to calculate an average Vp (step 4). After the calculation of the average Vp, the CPU 51 deactivates the primary transfer power source 50 (step 5). The CPU 51 rotates the eccentric cams 21*y*, 21*m*, 21*c* and 21*k* of the yellow, magenta and cyan image forming stations Sy, Sm, Sc and Sk by connecting unshown clutches to the eccentric cams. Then, as shown in (a) of FIG. 2, all the primary transfer brushes 5*y*, 5*m*, 5*c* and 5*k* as the second transfer member are placed in the contact state with the intermediary transfer belt 6 toward the photosensitive drums 1*y*, 1*m*, 1*c* and 1*k* as the second image bearing member (step 6). After the primary transfer brushes 5*y*, 5*m*, 5*c* and 5*k* are placed in the contact state, the primary transfer power source 50 is activated (step 7). After the primary transfer power source 50 is activated, Vp is applied as a transfer voltage for the image formation, that the toner images are transferred from the photosensitive drums 1*y*, 1*m* and 1*c* onto the outer peripheral surface of the intermediary transfer belt 6 (step 8). After the toner images are completely transferred from the photosensitive drums 1*y*, 1*m* and 1*c* onto the outer peripheral surface of the intermediary transfer belt 6, the application of the transfer voltage Vp is ended and then the primary transfer power source 50 is deactivated (step 9). After the deactivation of the primary transfer power source 50 is ended, the CPU 51 connects the unshown clutches to the eccentric cams 21*y*, 21*m*, 21*c* and 21*k* to rotate the eccentric cams 21*y*, 21*m*, 21*c* and 21*k*, so that as shown in (c) of FIG. 2, all the primary transfer brushes 5*y*, 5*m*, 5*c* and 5*k* is placed in the spaced state from the intermediary transfer belt 6 (step 10). After the spacing operation of the primary transfer brushes 5*y*, 5*m*, 5*c* and 5*k* is ended, the unshown intermediary transfer belt driving motor is stopped to end the image formation (step 11).

Figure 6:
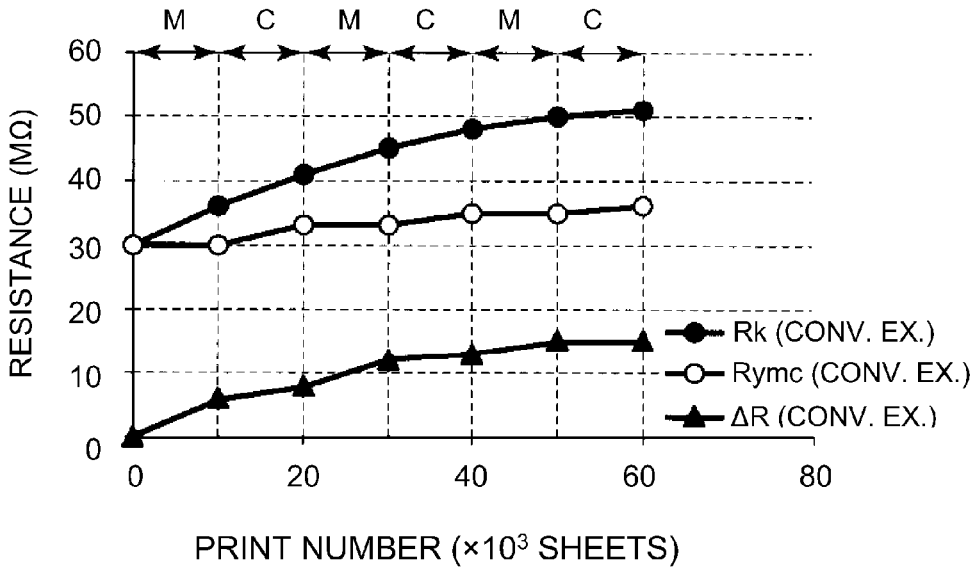
In FIG. 6, (a) and (b) are graphs each showing a resistance progression with a print number, in which (a) shows the resistance progression with the print number at each image forming station in an image forming apparatus in Conventional example, and (b) shows the resistance progression with the print number at each image forming station in the image forming apparatus in Embodiment 1.
Figure 6:
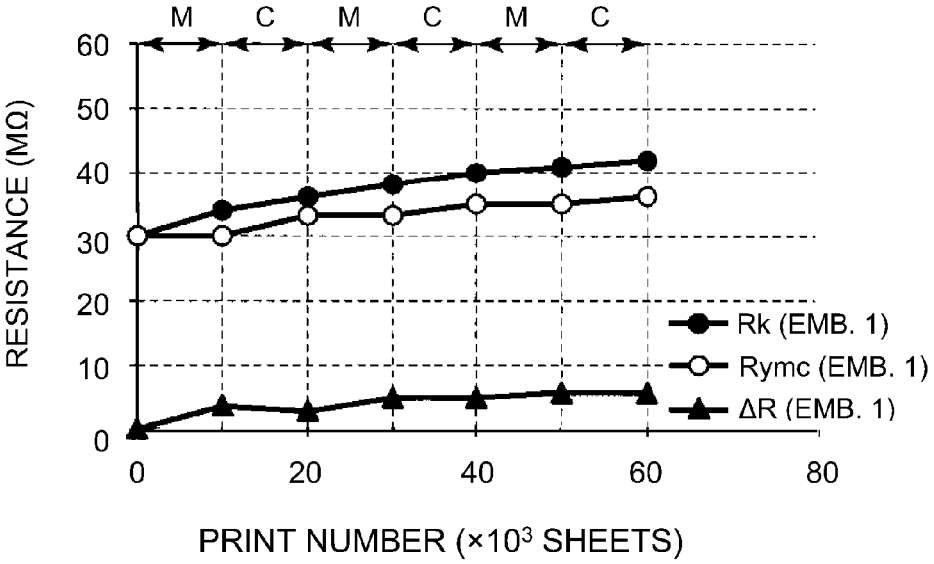

In FIG. 6, (a) and (b) show results of continuous image formation, in Conventional example and Embodiment 1, respectively, in which the operation in the monochromatic image forming mode ("M") and the opposite in the full-color mode ("C") are alternately performed. In each of (a) and (b) of FIG. 6, with respect to an increasing print number, progression of a resistance value Rk at the image forming station Sk, progression of an average resistance value Rymc at the image forming stations Sy, Sm and Sc, and progression of a difference ΔR=Rk−Rymc are shown.

The image formation was first carried out by the operation in the monochromatic image forming mode and then was carried out by the operation in the full-color image forming mode. These operations were alternately repeated every 10K ($10\times10^3$) sheets. At the time of switching, a rest state for 20 minutes was provided. Calculation of the resistance value was made at the time of start of the continuous image formation and immediately after each switching between the operations in the respective image forming modes.

Here, the resistance value Rk at the image forming station Sk was calculated according to the following equation by using a generation voltage Vp.

$$Rk=Vp/Im$$

In the above equation, Im represents the target current in step 4 in the monochromatic image forming sequence.

Further, the average resistance value Rymc at the image forming stations Sy, Sm and Sc was calculated according to the following equation.

$$Rymc=3Vp/(If-Im)$$

In the above equation, Im represents the target current in step 4 in the monochromatic image forming mode, and If represents the sum of transfer currents flowing through the image forming stations Sy, Sm, Sc and Ck in step 8 in the full-color image forming sequence.

Figure 5:
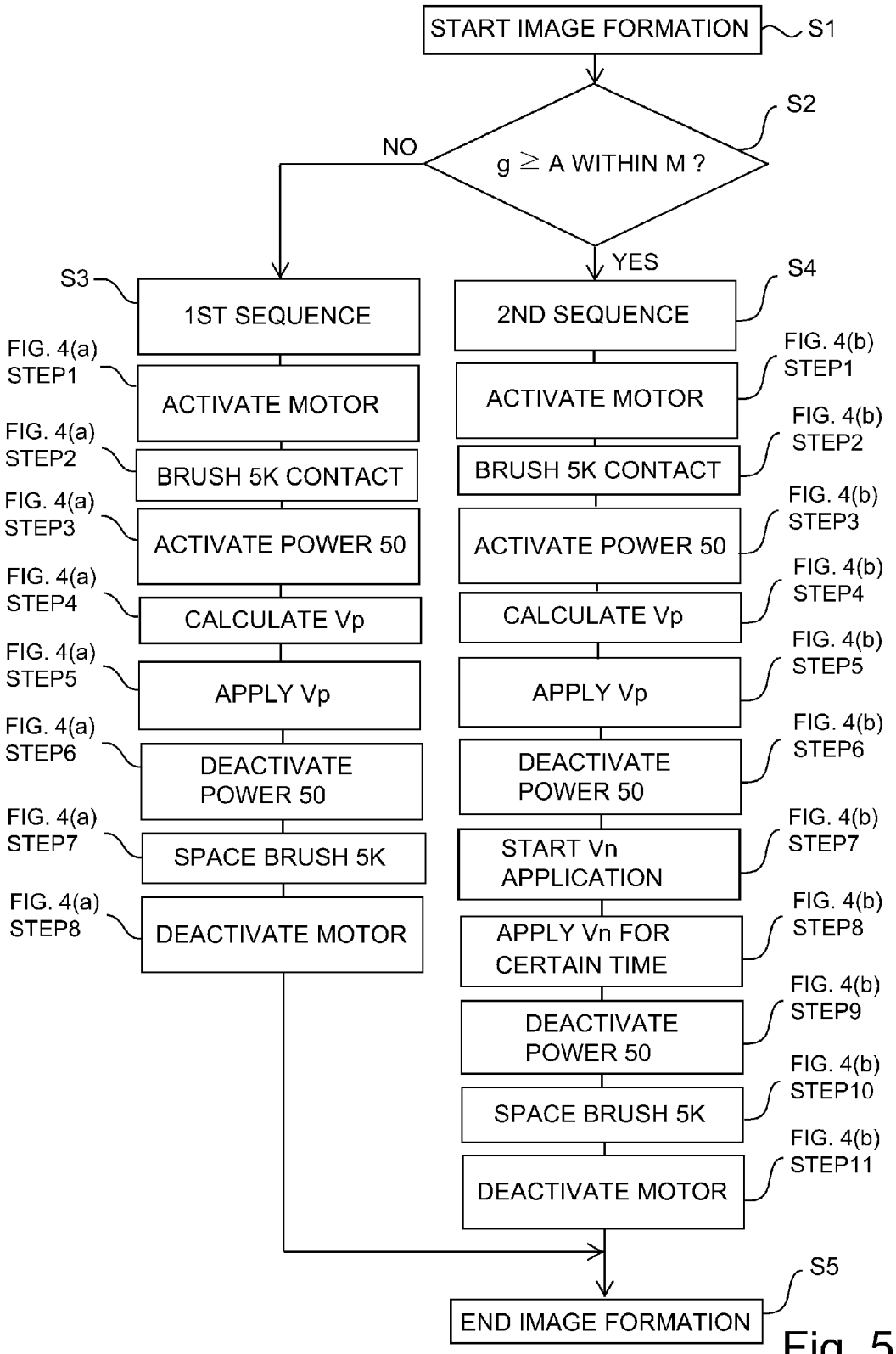
FIG. 5 is a flow chart showing a flow of mode determination of the monochromatic image forming modes in the image forming apparatus in Embodiment 1.

On the suppression of actual use of the image forming apparatus by a user, the continuous image formation was carried out by an intermittent operation, until the print number reaches $60\times10^3$ sheets which is the end of a lifetime of a main assembly of the image forming apparatus, in which a cycle of image formation of 2 sheets and then a rest for 5 seconds was repeated. During both the monochromatic image formation and the full-color image formation, the target current Im was 10 μA. In the flowchart of FIG. 5, a predetermined time M was 3 minutes, and a predetermined print number A was 10 sheets. Further, the adjusting voltage Vn of the opposite polarity to the polarity to the polarity of the transfer voltage Vp was −1000 V. Further, an application time of the adjusting voltage Vn was 1000 ms.

The above-described values are determined in advance by conducting a durability test so as to provide a small difference ΔR=Rk−Rymc.

Here, with reference to FIG. 5, the monochromatic image forming sequence in the present invention will be described.

In the case of the above setting, along the flowchart of FIG. 5, the first monochromatic image forming sequence is executed until the print number reaches 9 sheets. After 10-th sheet or later, the second monochromatic image forming sequence is executed.

That is, in the flowchart of FIG. 5, when the monochromatic image formation is started (S1), the print number (the number of sheets subjected to the image formation), i.e., in this embodiment, "g" which represents the print number within 3 minutes ("M") in the operation in the monochromatic image forming mode, is discriminated as to whether or not "g" is not less than "T" (10 sheets which is the predetermined print number) (S2). In the case of less than 10 sheets, i.e., in the case of "NO" in S1, the first monochromatic image forming sequence is executed, so that step 1 to step 5 in (a) of FIG. 4 are carried out (S3). In step 6 of (a) of FIG. 4, the transfer voltage Vp is turned off, and then is step 7 of (a) of FIG. 4, the primary transfer brush 5*k* is spaced from the intermediary transfer belt 6 at the black image forming station. Thereafter, in step of (a) of FIG. 4, the drive of the intermediary transfer belt 6 is stopped. Thus, the monochromatic image formation is ended (S5).

In the case where the print number in the operation in the monochromatic image forming mode is 10 sheets or more, i.e., in the case of "YES" in S2, the sequence is switched to the second monochromatic image forming sequence (S4), and then step 1 to step 5 of (b) of FIG. 4 are carried out, along steps 6, 7 and 8 of (b) of FIG. 4, the adjusting voltage Vn of the opposite polarity to the polarity of the transfer voltage Vp is applied, and then the adjusting voltage Vn is turned off in step 9 of (b) of FIG. 4. Thereafter, the spacing of the primary transfer brush 5*k* in step 10 of (b) of FIG. 4 and the drive stop of the intermediary transfer belt 6 in step 11 of (b) of FIG. 4 are performed. Thus, the monochromatic image formation is ended (S5).

Further, until 10 sheets after the image forming mode is switched from the full-color image forming mode to the monochromatic image forming mode, the first monochromatic image forming sequence is carried out, and then the second monochromatic image forming sequence is carried out.

As shown in (a) and (b) of FIG. 6, in both Conventional example and Embodiment 1, the average resistance value Rymc at the image forming stations Sy, Sm and Sc was 30 MΩ at the time of start of the continuous image formation, whereas the average resistance value Rymc was 37 MΩ after the end of the continuous image formation of $60\times10^3$ sheets, so that the average resistance value Rymc was increased by 7 MΩ by the continuous image formation. The increase in resistance was not generated during the monochromatic image formation, but was generated only during the full-color image formation. This would be considered because the anion component of the ion conductive agent is not deposited on the surfaces of the primary transfer brushes 5*y*, 5*m* and 5*c* since the primary transfer brushes 5*y*, 5*m* and 5*c* of the image forming stations Sy, Sm and Sc are spaced from the intermediary transfer belt 6 during the monochromatic image formation. In Conventional example shown in (a) of FIG. 6, the resistance value Rk at the image forming station Sk was 30 MΩ as an initial value and was 51 MΩ after the end of the continuous image formation of $60\times10^3$ sheets, and therefore, the resistance was increased by 21 MΩ by the continuous image formation.

On the other hand, in Embodiment 1 shown in (b) of FIG. 6, the resistance value Rk was 30 MΩ as the initial value and was 42 MΩ after the end of the continuous image formation of $60\times10^3$ sheets and therefore the increase in resistance by the continuous image formation was suppressed to 12 MΩ. This is because in this embodiment, the resistance value is suppressed by executing the second monochromatic image forming sequence in the case where the image formation of 10 sheets or more is carried out within 3 minutes. That is, it would be considered the anion component of the ion conductive agent moved to the belt back surface side by the transfer electric field number application of the transfer voltage Vp during the monochromatic image forming sequence is returned to the belt front surface side by applying the adjusting voltage Vn of the opposite polarity to the polarity of the transfer voltage Vp for 1000 ms, and as a result, the deposition of the anion component in the belt back surface side is suppressed. As a result, the resistance value difference, ΔR=Rk−Rymc, which is the difference between the resistance value Rk at the black image forming station Sk and the average resistance value Rymc at the image forming stations Sy, Sm and Sc was 14 MΩ in Conventional example, but was 5 MΩ in this embodiment, and therefore, also with respect to the resistance value difference ΔR, compared with Conventional example, the value of ΔR was considerably suppressed in this embodiment.

TABLE 1

| | | PRIMARY TRANSFER VOLTAGE (V) | | | | |
|---|---|---|---|---|---|---|
| | STATION | 100 | 200 | 300 | 400 | 500 |
| CONV. EX. | Sy, Sm AND Sc | C WE | B WE | A — | B SE | C SE |
| | Sk ALONE | C WE | C WE | B WE | A — | B SE |
| EMB. 1 | Sy, Sm AND Sc | C WE | B WE | A — | B SE | C SE |
| | Sk ALONE | C WE | B WE | A — | B SE | C SE |

In Table 1, "A" represents no generation of image defect, "B" represents image defect generation within tolerance limit, and "C" represents image defect generation more than tolerance limit. Further, "WE" represents the weak-field transfer error (failure), and "SE" represents the strong-field transfer error (failure).

Table 1 is an image evaluation result when the image formation is effected by the operation in the full-color image forming mode by using each of the image forming apparatus in Conventional example and the image forming apparatus in this embodiment (Embodiment 1), after the end of the continuous image formation of $60\times10^3$ sheets. The image evaluation was made in such a manner that the case where the image defect (strong-field transfer error, weak-field transfer error) more than the tolerance limit was evaluated as "C", the case where the image defect (strong-field transfer error, weak-field transfer error) within the tolerance limit was evaluated as "B", and the case where there was no image defect (strong-field transfer error, weak-field transfer error)

was evaluated as "A". During the image formation, constant voltages from 100 V to 500 V were applied with an increment of 100 V. As shown in Table 1, in the case where the image forming apparatus in Conventional example was used, at the image forming stations Sy, Sm and Sc, 300 V was an optimum value, as the primary transfer voltage, at which the image defect was not generated. On the other hand, at the image forming station Sk, 400 V was the optimum value as the primary transfer voltage. This would be considered because the transfer electric field is weakened at the image forming station Sk correspondingly to the increase in resistance value Rk at the image forming station Sk in Conventional example.

Accordingly, in Conventional example, even when any primary transfer voltage was selected, the image defect was generated at any of the image forming stations Sy, Sm and Sc or the image forming station Sk. On the other hand, in this embodiment, even at both the image forming stations Sy, Sm and Sc and the image forming station Sk, 300 V was the optimum value as the primary transfer voltage, so that both the image defect with the weak-field transfer error and the image defect with the strong-field transfer error were not generated.

Figure 7:
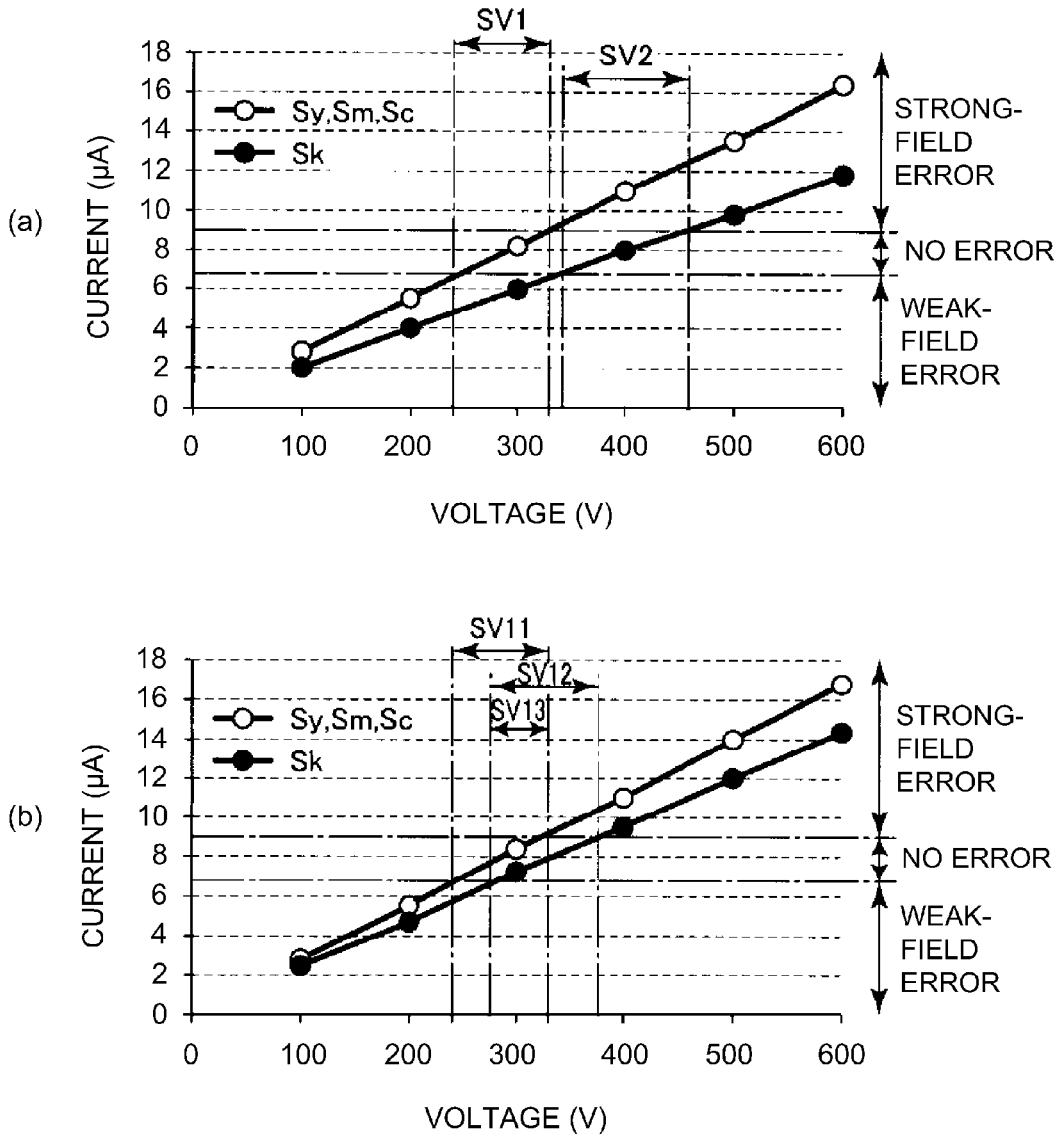
In FIG. 7, (a) and (b) are graphs each showing a relationship between a primary transfer voltage, a current and image defect in the image forming apparatus in Conventional example or Embodiment 1, in which (a) shows the case of the image forming apparatus in Conventional example, and (b) shows the case of the image forming apparatus in Embodiment 1.

In FIG. 7, (a) is a graph showing a relationship between a voltage and a current at the image forming station Sk and at the image forming stations and showing an image defect generation range in Conventional example, and (b) is a graph showing the relationship and the image defect generation range in Embodiment 1.

As shown in (a) of FIG. 7, in Conventional example, at both the image forming station Sk and the image forming stations Sy, Sm and Sc, the image defect was not generated in a current value range of 7-9 μA, the strong-field transfer error was generated at the current value exceeding 9 μA, and the weak-field transfer error was generated at the current value less than 7 μA. This is true for Embodiment 1 shown in (b) of FIG. 7. That is, it was turned out that the generation or non-generation of the image defect is determined by the current value.

From the viewpoint of this current value, in Conventional example, after the continuous image formation, the resistance at the image forming station Sk and the resistance at the image forming stations Sy, Sm and Sc are largely different from each other, and thus when a common primary transfer voltage is applied, the resultant current values are also largely different from each other, and therefore, either one of the image defects is generated. On the other hand, in this embodiment, after the continuous image formation, there is no large difference in resistance value between the image forming station Sk and the image forming stations Sy, Sm and Sc, and therefore, there is also no large difference even in the case where the common primary transfer voltage is applied. Accordingly, when setting is made so that the current of a proper value flows through the image forming stations, it is possible to suppress and prevent the generation of both the image defects.

Next, from the viewpoint of the voltage value, at the image forming station Sk after the continuous image formation in Conventional example, the image defect was not generated in a voltage range SV2 in (a) of FIG. 7. Further, at the image forming stations Sy, Sm and Sc after the continuous image formation in Conventional example, the image defect was not generated in a voltage range SV1 in (a) of FIG. 7. However, in (a) of FIG. 7, there was no overlapping voltage range between the voltage range SV1 and the voltage range SV2, and therefore there was no voltage range in which the image defect was not generated at both the image forming station Sk and the image forming stations Sy, Sm and Sc after the continuous image formation. On the other hand, at both the image forming station Sk and the image forming stations Sy, Sm and Sc after the continuous image formation in this embodiment, the image defect was not generated in an overlapping voltage range SV13 between a voltage range SV11 and a voltage range SV12 in (b) of FIG. 7.

As described above, according to this embodiment, by suppressing the resistance increase at the image forming station Sk, it is possible to suppress the resistance increase difference between the image forming stations Sy, Sm and Sc and the image forming station Sk.

As a result, by setting the transfer voltage value in the above overlapping voltage range SV13, it is possible to suppress and prevent the generation of the image defects (weak-field transfer error and strong-field transfer error) generated due to the resistance increase difference between the image forming stations.

That is, in this embodiment in which the second monochromatic image forming sequence including the adjusting operation is executable after the image formation of a predetermined number of transfer materials (sheets), it is possible to suppress the resistance increase difference between the image forming stations, and thus it is possible to suppress and prevent the generation of the image defects.

<Embodiment 2>

An image forming apparatus in this embodiment is only different from the image forming apparatus in Embodiment 1 in that a third monochromatic image forming sequence is executed in place of the second monochromatic image forming sequence in Embodiment 1. Other constitutions of the image forming apparatus in this embodiment are the same as those of the image forming apparatus in Embodiment 1, and therefore will be omitted from description.

(Third Monochromatic Image Forming Sequence)

Figure 8:
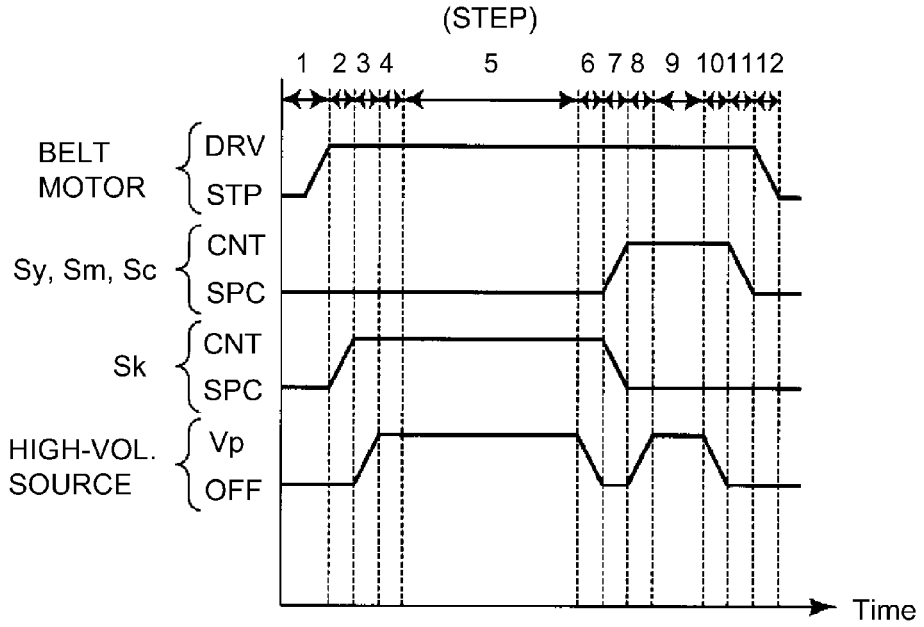
In FIG. 8, (a) and (b) are a time chart showing an image forming sequence and a graph showing a resistance progression with a print number, respectively, in Embodiment 2, in which (a) shows a third monochromatic image forming sequence, and (b) shows the resistance progression with the print number at the respective image forming stations.
Figure 8:
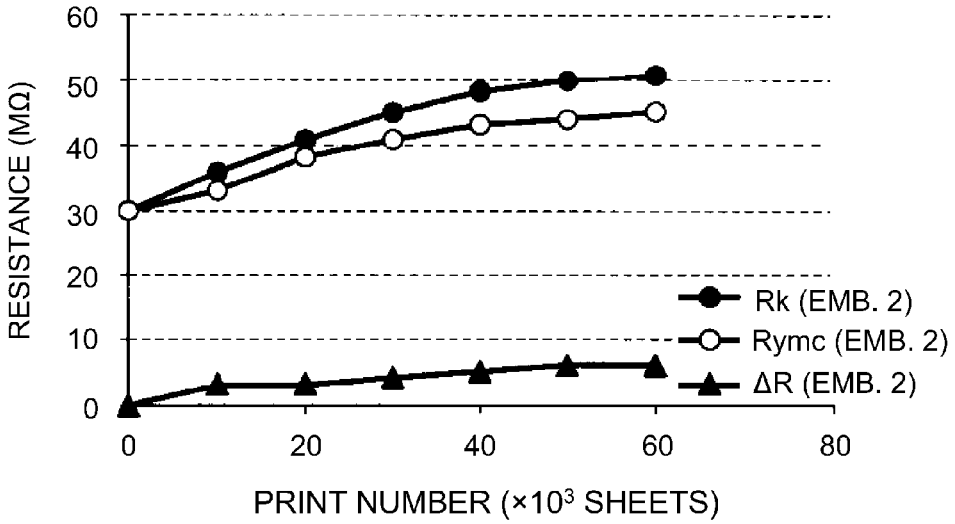

In this embodiment, (a) of FIG. 8 shows a sequence chart the third monochromatic image forming sequence in this embodiment.

When the image forming apparatus 100 receives a print signal from an unshown host information device such as a personal computer, the image forming apparatus 100 starts a printing operation to activate (actuate) an unshown intermediary transfer belt driving motor (step 1). The CPU 51 rotates the eccentric cam 21*k* of the black image forming station Sk by connecting an unshown clutch with the eccentric cam 21*k*. Then, as shown in (b) of FIG. 2, only the primary transfer brush 5*k* is placed in the contact state with the intermediary transfer belt 6 toward the photosensitive drum 1*k* (step 2). After the primary transfer brush 5*k* is placed in the contact state, the primary transfer power source 50 is activated (step 3). The CPU 51 effects a constant current control of the primary transfer power source 50 at a target current Im, and then stores a generated voltage value Va of the primary transfer power source 50 at that time for a predetermined time to calculate an average Vp (step 4). After the calculation of the average Vp, Vp is applied as a transfer voltage for the image formation, that the toner image is transferred from the photosensitive drum 1*k* onto the outer peripheral surface of the intermediary transfer belt 6 (step 5). After the toner image is completely transferred from the photosensitive drum 1*k* onto the outer peripheral surface of the intermediary transfer belt 6, the application of the transfer voltage Vp is ended and then the primary transfer power source 50 is deactivated (step 6). After the deactivation of the primary transfer power source 50 is ended, the CPU 51 connects the unshown clutch to the eccentric cam 21*k* to rotate the eccentric cam 21*k*, so that as shown in (c) of FIG. 2, the primary transfer brush 5*k* is placed in the spaced state from the intermediary transfer belt 6. At the same time, by connecting the unshown clutches to the eccentric cams 21*y*, 21*m* and 21*c*, the eccentric cams 21*y*, 21*m* and

21*c* of the yellow, magenta and cyan image forming stations Sy, Sm and Sc are rotated, so that the primary transfer brushes 5*y*, 5*m* and 5*c* are placed in the contact state with the intermediary transfer belt 6 toward the photosensitive drums 1*y*, 1*m* and 1*c* (step 7). After the contact state, the primary transfer power source 50 is activated (step 8). After the primary transfer power source 50 is activated, a voltage Vq of a polarity identical to the polarity of the transfer voltage Vp is applied for a predetermined time T2 (step 9). After the application of the voltage Vq of the identical polarity to the polarity of the transfer voltage Vp, the primary transfer power source 50 is deactivated (step 10). After the primary transfer power source 50 is deactivated, the CPU 51 connects the unshown clutches to the eccentric cams 21*y*, 21*m* and 21*c* to rotate the eccentric cams 21*y*, 21*m* and 21*c*, thus placing the primary transfer brushes 5*y*, 5*m* and 5*c* in the spaced state from the intermediary transfer belt 6 as shown in (c) of FIG. 2 (step 11). After the spacing operation is ended, the unshown intermediary transfer belt driving motor is deactivated (step 12).

As described above, in the case where the monochromatic image formation of the predetermined print number or more is carried out within the predetermined time, by executing the third monochromatic image forming sequence, not only the resistance at the image forming station Sk but also the resistance at the image forming stations Sy, Sm and Sc are increased. As a result, it becomes possible to suppress the resistance value difference ΔR between the resistance at the image forming station Sk and the resistance at the image forming stations Sy, Sm and Sc.

This is because in step 9 of the third monochromatic image forming sequence, the primary transfer current flow through only the image forming stations Sy, Sm and Sc but does not flow through the image forming station Sk.

In FIG. 8, (b) shows a result of continuous image formation in this embodiment similarly effected as Embodiment 1 in which the operation in the monochromatic image forming mode ("M") and the opposite in the full-color mode ("C") are alternately performed. In (b) of FIG. 8, with respect to an increasing print number, progression of a resistance value Rk at the image forming station Sk, progression of an average resistance value Rymc at the image forming stations Sy, Sm and Sc, and progression of a difference ΔR=Rk−Rymc are shown.

In this embodiment, the voltage Vq was 800 V. Further, the predetermined application time T2 was 1000 ms. The above-described values are determined in advance by conducting a durability test so as to provide a small difference ΔR. In this embodiment shown in (b) of FIG. 8, similarly as in Conventional example, the resistance value Rk at the image forming station Sk was 30 MΩ as an initial value and was 51 MΩ after the end of the continuous image formation of $60\times10^3$ sheets, and therefore, the resistance was increased by 21 MΩ by the continuous image formation. With reference to the average resistance value Rymc at the image forming stations Sy, Sm and Sc, in Conventional example, it was not increased during the monochromatic image formation, but was increased during the full-color image formation. Specifically, as shown in (a) of FIG. 6, the average resistance value Rymc was 30 MΩ at the time of start of the continuous image formation, whereas the average resistance value Rymc was 37 MΩ after the end of the continuous image formation of $60\times10^3$ sheets, so that the average resistance value Rymc was increased by 7 MΩ by the continuous image formation. On the other hand, in this embodiment, the average resistance value Rymc was increased not only during the full-color image formation but also during the monochromatic image formation, and was 30 MΩ as the initial value, whereas the average resistance value Rymc was 45 MΩ after the end of the continuous image formation of $60\times10^3$ sheets, so that the average resistance value Rymc was increased by 15 MΩ by the continuous image formation.

This would be considered because in this embodiment, the primary transfer voltage is applied in the contact state of the primary transfer brushes 5*y*, 5*m* and 5*c* of the image forming stations Sy, Sm and Sc by executing the third monochromatic image forming sequence also during the monochromatic image formation, and therefore, similarly as in the case of the image forming station Sk, the anion component of the ion conductive agent is deposited on the surface of the primary transfer member to increase the resistance.

As shown by the above results, in this embodiment, also the average resistance value Rymc at the image forming stations Sy, Sm and Sc was increased similarly as the case of the resistance Rk at the image forming station Sk. As a result, the resistance value difference ΔR which is the difference between the resistance value Rk at the black image forming station Sk and the average resistance value Rymc at the image forming stations Sy, Sm and Sc was 14 MΩ in Conventional example, but was 6 MΩ in this embodiment, and therefore, compared with Conventional example, the value of ΔR was considerably suppressed in this embodiment.

TABLE 2

| | | PRIMARY TRANSFER VOLTAGE (V) | | | | |
|---|---|---|---|---|---|---|
| | STATION | 100 | 200 | 300 | 400 | 500 |
| EMB. 2 | Sy, Sm | C | B | B | A | B |
| | AND Sc | WE | WE | WE | — | SE |
| | Sk | C | C | B | A | B |
| | ALONE | WE | WE | WE | — | SE |

In Table 2, "A" represents no generation of image defect, "B" represents image defect generation within tolerance limit, and "C" represents image defect generation more than tolerance limit. Further, "WE" represents the weak-field transfer error (failure), and "SE" represents the strong-field transfer error (failure).

Table 2 shows an image evaluation result similar to that in Table 1 of Embodiment 1. As shown in Table 1, in the image forming apparatus in Conventional example, either one of the image defects with the strong-field transfer error and the weak-field transfer error was generated even at any of the transfer voltages Vp. On the other hand, as shown in Table 2, in this embodiment, when the transfer voltage Vp was 400 V, both the image defects with the strong-field transfer error and the weak-field transfer error were not generated. This would be considered because the average resistance value Rymc at the image forming stations Sy, Sm and Sc in this embodiment is increased similarly as the resistance value Rk at the image forming station Sk and thus also the transfer electric field at the image forming stations, Sy, Sm and Sc is weakened similarly as in the transfer electric field at the image forming station Sk.

As described above, according to this embodiment, by increasing the resistance value at the image forming stations, Sy, Sm and Sc similarly as the resistance value at the image forming station Sk, it is possible to suppress the resistance increase difference between the image forming stations Sy, Sm and Sc and the image forming station Sk, so that it is possible to suppress and prevent the generation of the image defects (weak-field transfer error and strong-field transfer error) generated due to the resistance increase difference between the image forming stations.

<Embodiment 3>

An image forming apparatus in this embodiment is only different from the image forming apparatus in Embodiment 1 in that a fourth monochromatic image forming sequence is executed in place of the monochromatic image forming sequences in Embodiments 1 and 2. Other constitutions of the image forming apparatus in this embodiment are the same as those of the image forming apparatus in Embodiment 1, and therefore will be omitted from description.

(Fourth Monochromatic Image Forming Sequence)

Figure 9:
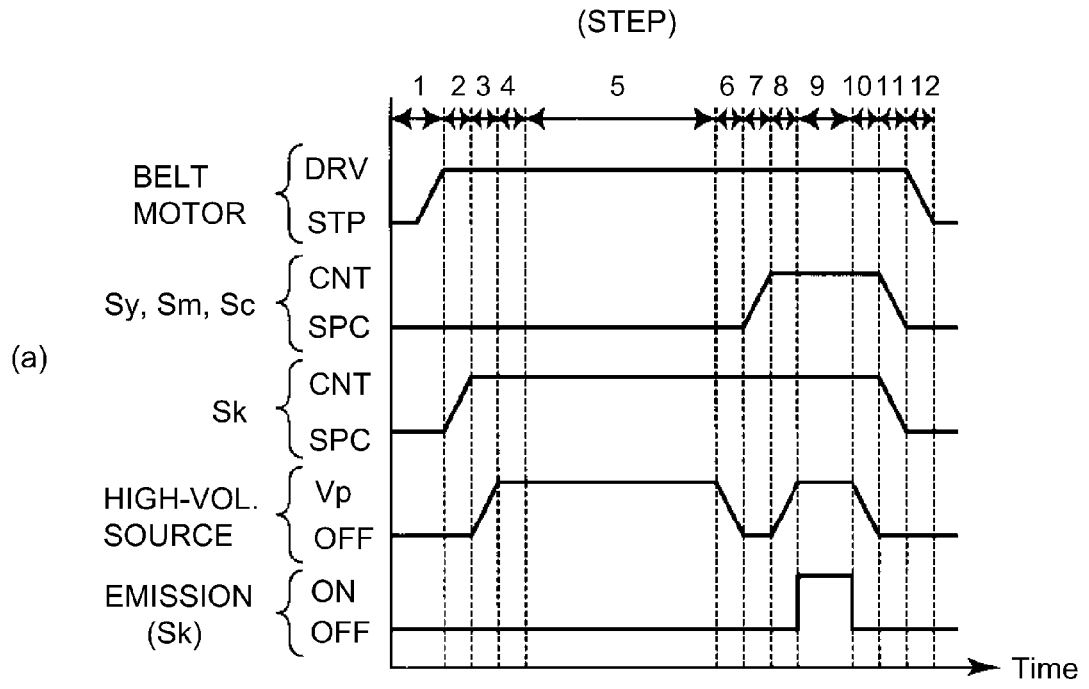
In FIG. 9, (a) and (b) are a time chart showing an image forming sequence and a graph showing a resistance progression with a print number, respectively, in Embodiment 3, in which (a) shows a third monochromatic image forming sequence, and (b) shows the resistance progression with the print number at the respective image forming stations.
Figure 9:
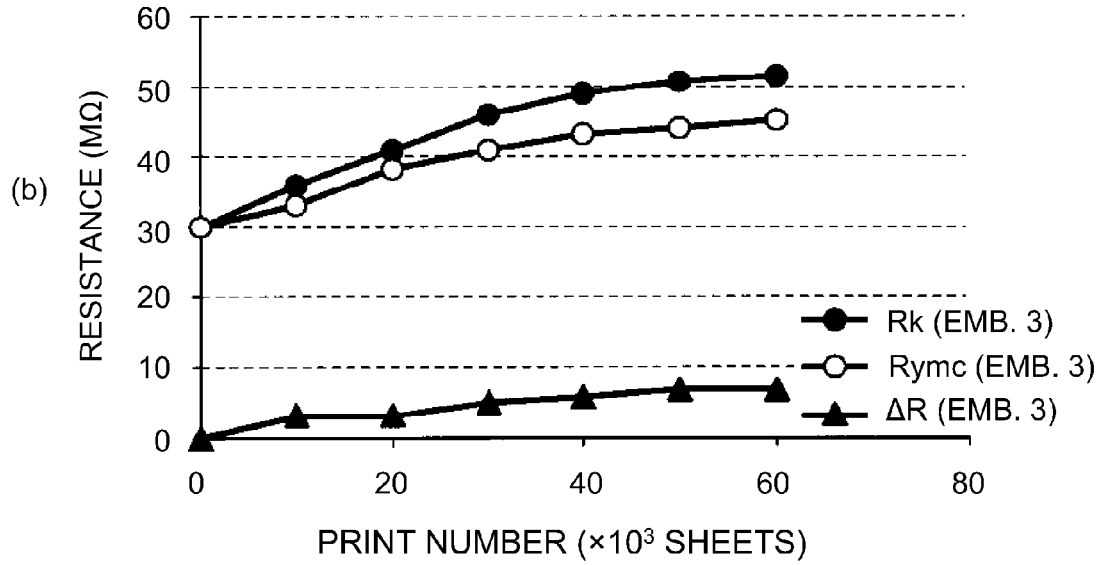

In this embodiment, (a) of FIG. 9 shows a sequence chart the fourth monochromatic image forming sequence in this embodiment.

When the image forming apparatus 100 receives a print signal from an unshown host information device such as a personal computer, the image forming apparatus 100 starts a printing operation to activate (actuate) an unshown intermediary transfer belt driving motor (step 1). The CPU 51 rotates the eccentric cam 21*k* of the black image forming station Sk by connecting an unshown clutch with the eccentric cam 21*k*. Then, as shown in (b) of FIG. 2, only the primary transfer brush 5*k* is placed in the contact state with the intermediary transfer belt 6 toward the photosensitive drum 1*k* (step 2). After the primary transfer brush 5*k* is placed in the contact state, the primary transfer power source 50 is activated (step 3). The CPU 51 effects a constant current control of the primary transfer power source 50 at a target current Im, and then stores a generated voltage value Va of the primary transfer power source 50 at that time for a predetermined time to calculate an average Vp (step 4). After the calculation of the average Vp, Vp is applied as a transfer voltage for the image formation, that the toner image is transferred from the photosensitive drum 1*k* onto the outer peripheral surface of the intermediary transfer belt 6 (step 5). After the toner image is completely transferred from the photosensitive drum 1*k* onto the outer peripheral surface of the intermediary transfer belt 6, the application of the transfer voltage Vp is ended and then the primary transfer power source 50 is deactivated (step 6). After the deactivation of the primary transfer power source 50 is ended, the CPU 51 connects the unshown clutches to the eccentric cams 21*y*, 21*m* and 21*c* as shown in (a) of FIG. 2, the eccentric cams 21*y*, 21*m* and 21*c* of the yellow, magenta and cyan image forming stations Sy, Sm and Sc are rotated, so that all the primary transfer brushes 5*y*, 5*m*, 5*c* and 5*k* are placed in the contact state with the intermediary transfer belt 6 toward the photosensitive drums 1*y*, 1*m*, 1*c* and 1*k* (step 7). After the contact state, the primary transfer power source 50 is activated (step 8). After the primary transfer power source 50 is activated, forced light emission of the exposure is carried out at the image forming station Sk to lower a potential of the photosensitive drum 1*k*, and at the same time, a voltage Vq of a polarity identical to the polarity of the transfer voltage Vp is applied for a predetermined time T2 (step 9). After the application of the voltage Vq of the identical polarity to the polarity of the transfer voltage Vp, the primary transfer power source 50 is deactivated (step 10). After the primary transfer power source 50 is deactivated, the CPU 51 connects the unshown clutches to the eccentric cams 21*y*, 21*m*, and 21*c* to rotate the eccentric cams 21*y*, 21*m*, 21*c* and 21*k*, thus placing the primary transfer brushes 5*y*, 5*m*, 5*c* and 5*k* in the spaced state from the intermediary transfer belt 6 as shown in (c) of FIG. 2 (step 11). After the spacing operation is ended, the unshown intermediary transfer belt driving motor is deactivated (step 12).

As described above, in the case where the monochromatic image formation of the predetermined print number or more is carried out within the predetermined time, by executing the third monochromatic image forming sequence, not only the resistance at the image forming station Sk but also the resistance at the image forming stations Sy, Sm and Sc are increased, so that it becomes possible to suppress the resistance at the image forming station Sk and the resistance value difference ΔR at the image forming stations Sy, Sm and Sc.

In step 9, the primary transfer current flows through the image forming station Sy, Sm and Sc but little flows through the image forming station Sk. This is because in step 9, the surface potential of the photosensitive drum 1*k* is lowered by the forced light emission by the exposure device 3*k*, and thus a contract with the voltage Vq is made smaller than an electric discharge threshold. As a result, by the sequence in step 9, the anion component of the ion conductive agent is deposited on the primary transfer brushes 5*y*, 5*m* and 5*c* at the image forming stations Sy, Sm and Sc, and therefore the resistance at the image forming stations Sy, Sm and Sc is increased. As described above, it becomes possible to suppress the resistance value difference ΔR between the resistance at the image forming station Sk and the resistance at the image forming stations Sy, Sm and Sc.

In FIG. 9, (b) shows a result of continuous image formation in this embodiment similarly effected as Embodiments 1 and 2, in which the operation in the monochromatic image forming mode ("M") and the opposite in the full-color mode ("C") are alternately performed. In (b) of FIG. 9, with respect to an increasing print number, progression of a resistance value Rk at the image forming station Sk, progression of an average resistance value Rymc at the image forming stations Sy, Sm and Sc, and progression of a difference ΔR=Rk−Rymc are shown.

In this embodiment, the voltage Vq was 800 V. Further, the predetermined application time T2 was 1000 ms. The above-described values are determined in advance by conducting a durability test so as to provide a small difference ΔR. In this embodiment shown in (b) of FIG. 9, the resistance value Rk at the black image forming station Sk was 30 MΩ as an initial value and was 52 MΩ after the end of the continuous image formation of $60\times10^3$ sheets, and therefore, the resistance was increased by 22 MΩ by the continuous image formation. On the other hand, the average resistance value Rymc at other image forming stations Sy, Sm and Sc was 30 MΩ as the initial value, whereas the average resistance value Rymc was 37 MΩ after the end of the continuous image formation of $60\times10^3$ sheets, so that the average resistance value Rymc was increased only by 7 MΩ by the continuous image formation. On the other hand, in this embodiment, the average resistance value Rymc was 30 MΩ as the initial value, whereas the average resistance value Rymc was 45 MΩ after the end of the continuous image formation of $60\times10^3$ sheets, so that the average resistance value Rymc was increased by 15 MΩ by the continuous image formation.

This would be considered because in this embodiment, similarly as in Embodiment 2, the primary transfer voltage is applied in the contact state of the primary transfer brushes 5*y*, 5*m* and 5*c* of the image forming stations Sy, Sm and Sc by executing the fourth monochromatic image forming sequence in the case where the monochromatic image formation of 10 sheets or more is carried out within 3 minutes, and therefore, similarly as in the case of the image forming station Sk, the anion component of the ion conductive agent is deposited on the surface of the primary transfer member to increase the resistance.

As shown by the above results, also in this embodiment, similarly as in Embodiment 2, also the average resistance value Rymc at the image forming stations Sy, Sm and Sc was increased similarly as the case of the resistance Rk at the image forming station Sk. As a result, the resistance value difference ΔR which is the difference between the resistance value Rk at the black image forming station Sk and the average resistance value Rymc at the image forming stations Sy, Sm and Sc was 14 MΩ in Conventional example, but was 7 MΩ in this embodiment, and therefore, compared with Conventional example, the value of ΔR was considerably suppressed in this embodiment.

TABLE 3

| | | PRIMARY TRANSFER VOLTAGE (V) | | | | |
|---|---|---|---|---|---|---|
| | STATION | 100 | 200 | 300 | 400 | 500 |
| EMB. 3 | Sy, Sm | C | B | B | A | B |
| | AND Sc | WE | WE | WE | — | SE |
| | Sk | C | C | B | A | B |
| | ALONE | WE | WE | WE | — | SE |

In Table 3, "A" represents no generation of image defect, "B" represents image defect generation within tolerance limit, and "C" represents image defect generation more than tolerance limit. Further, "WE" represents the weak-field transfer error (failure), and "SE" represents the strong-field transfer error (failure).

Table 3 shows an image evaluation result similar to those in Tables 1 and 2 of Embodiments 1 and 2. As shown in Table 1, in the image forming apparatus in Conventional example, either one of the image defects with the strong-field transfer error and the weak-field transfer error was generated even at any of the transfer voltages. On the other hand, as shown in Table 3, in this embodiment, similarly as in Embodiment 2, when the transfer voltage V was 400 V, both the image defects with the strong-field transfer error and the weak-field transfer error were not generated. This would be considered because, similarly as in Embodiment 2, the average resistance value Rymc at the image forming stations Sy, Sm and Sc in this embodiment is increased similarly as the resistance value Rk at the image forming station Sk and thus also the transfer electric field at the image forming stations, Sy, Sm and Sc is weakened similarly as in the transfer electric field at the image forming station Sk.

As described above, also according to this embodiment, by increasing the resistance value at the image forming stations, Sy, Sm and Sc similarly as the resistance value at the image forming station Sk similarly as in Embodiment 2, it is possible to suppress the resistance increase difference between the image forming stations Sy, Sm and Sc and the image forming station Sk, so that it is possible to suppress and prevent the generation of the image defects (weak-field transfer error and strong-field transfer error) generated due to the resistance increase difference between the image forming stations.

Incidentally, in step 9 in this embodiment, the voltage Vq of the identical polarity to the polarity of the transfer voltage Vp is applied, but the voltage Vq may also have the opposite polarity to the polarity of the transfer voltage Vp. This is because an effect such that the resistance increase difference in suppressed can be similarly obtained by lowering the resistances at the respective image forming stations.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 127001/2013 filed Jun. 17, 2013, which is hereby incorporated by reference.

What is claimed is:

1. An image forming apparatus comprising:

a first image bearing member for bearing a toner image;

a second image bearing member for bearing a toner image;

a transfer belt having electroconductivity;

a first transfer member provided correspondingly to said first image bearing member via said transfer belt;

a second transfer member provided correspondingly to said second image bearing member via said transfer belt;

a high-voltage power source for applying a voltage to said first and second transfer members; and a controller, wherein after an image is continuously formed on a plurality of transfer materials by applying, to said first transfer member, a voltage of a predetermined polarity from said high-voltage power source in a state in which said first transfer member contacts said transfer belt and in which said second transfer member is spaced from said transfer belt, said controller executes an adjusting operation in which a voltage of a polarity opposite to the predetermined polarity is applied from said high-voltage power source to said first transfer member in a state in which said second transfer member is spaced from said transfer belt.

2. An image forming apparatus according to claim 1, wherein said transfer belt is a belt containing an ion conductive agent.

3. An image forming apparatus according to claim 2, wherein each of said first and second transfer members is a fixed transfer member rubbing against said transfer belt.

4. An image forming apparatus according to claim 3, wherein each of said first and second transfer members includes brush fibers rubbing against said transfer belt and a holding portion for holding the brush fibers.

5. An image forming apparatus according to claim 4, wherein each of said first and second transfer members further includes a swingable arm, wherein said image forming apparatus further comprises a contact-and-separation unit for moving each of said first and second transfer members toward and away from said transfer belt by swinging an associated swingable arm.

6. An image forming apparatus according to claim 1, wherein the adjusting operation is always performed after the image is continuously formed on the plurality of transfer materials by applying, to said first transfer member, the voltage of the predetermined polarity from said high-voltage power source in the state in which said first transfer member contacts said transfer belt and in which said second transfer member is spaced from said transfer belt.

7. An image forming apparatus according to claim 1, further comprising:

a third image bearing member for bearing a toner image;

a fourth image bearing member for bearing a toner image;

a third transfer member provided correspondingly to said third image bearing member via said transfer belt; and a fourth transfer member provided correspondingly to said fourth image bearing member via said transfer belt, wherein said high-voltage power source applies a voltage to said third and fourth transfer members.

8. An image forming apparatus according to claim 7, wherein in a state in which said first transfer member contacts said transfer belt and in which said second transfer member is spaced from said transfer belt, said third and fourth transfer members are spaced from said transfer belt similarly as said second transfer member.

9. An image forming apparatus comprising:

a first image bearing member for bearing a toner image;

a second image bearing member for bearing a toner image;

a transfer belt having electroconductivity;

a first transfer member provided correspondingly to said first image bearing member via said transfer belt;

a second transfer member provided correspondingly to said second image bearing member via said transfer belt;

a high-voltage power source for applying a voltage to said first and second transfer members; and a controller, wherein after an image is continuously formed on a plurality of transfer materials by applying, to said first transfer member, a voltage of a predetermined polarity from said high-voltage power source in a state in which said first transfer member contacts said transfer belt and in which said second transfer member is spaced from said transfer belt, said controller executes an adjusting operation in which a voltage of a polarity identical to the predetermined polarity is applied from said high-voltage power source to said second transfer member in a state in which said first transfer member is spaced from said transfer belt and in which said second transfer member contacts said transfer belt.

10. An image forming apparatus according to claim 9, wherein said transfer belt is a belt containing an ion conductive agent.

11. An image forming apparatus according to claim 10, wherein each of said first and second transfer members is a fixed transfer member rubbing against said transfer belt.

12. An image forming apparatus according to claim 11, wherein each of said first and second transfer members includes brush fibers rubbing against said transfer belt and a holding portion for holding the brush fibers.

13. An image forming apparatus according to claim 12, wherein each of said first and second transfer members further includes a swingable arm, wherein said image forming apparatus further comprises a contact-and-separation unit for moving each of said first and second transfer members toward and away from said transfer belt by swinging an associated swingable arm.

14. An image forming apparatus according to claim 9, wherein the adjusting operation is always performed after the image is continuously formed on the plurality of transfer materials by applying, to said first transfer member, the voltage of the predetermined polarity from said high-voltage power source in the state in which said first transfer member contacts said transfer belt and in which said second transfer member is spaced from said transfer belt.

15. An image forming apparatus according to claim 9, further comprising:

a third image bearing member for bearing a toner image;

a fourth image bearing member for bearing a toner image;

a third transfer member provided correspondingly to said third image bearing member via said transfer belt; and a fourth transfer member provided correspondingly to said fourth image bearing member via said transfer belt, wherein said high-voltage power source applies a voltage to said third and fourth transfer members.

16. An image forming apparatus according to claim 15, wherein in a state in which said first transfer member is spaced from said transfer belt and in which said second transfer member contacts said transfer belt, said third and fourth transfer members contact said transfer belt similarly as said second transfer member.

* * * * *